US005463539A

United States Patent [19]

Vandenbelt et al.

[11] Patent Number: 5,463,539

[45] Date of Patent: Oct. 31, 1995

[54] MINIATURE POCKET FLASHLIGHT WITH LENS MODULE AND OUTER FLEXIBLE SHEATH

[75] Inventors: Rudy Vandenbelt, Ottawa, Canada; Peter R. Altman, Austin, Tex.

[73] Assignee: Lumatec Industries, Inc., Austin, Tex.

[21] Appl. No.: 165,736

[22] Filed: Dec. 10, 1993

[51] Int. Cl.[6] ..... F21L 7/00

[52] U.S. Cl. ..... 362/189; 362/196; 362/116; 362/200

[58] Field of Search ..... 362/189, 201, 362/202, 200, 204, 116, 205, 208, 196

[56] References Cited

U.S. PATENT DOCUMENTS

| | | | |
|---|---|---|---|
| 1,397,705 | 11/1921 | Shaw et al. | 362/189 |
| 2,465,114 | 3/1995 | Oury | 362/196 |
| 2,522,660 | 9/1950 | Bledsoe, Jr. | 362/189 X |
| 2,553,307 | 5/1951 | Falge | 362/189 X |
| 2,625,645 | 1/1953 | Crane | 362/116 |
| 2,632,094 | 3/1953 | Akerley | 362/189 |
| 2,699,192 | 1/1955 | Poutinen | 362/116 |
| 3,243,586 | 3/1966 | Fioravanti | 362/116 |
| 3,296,429 | 1/1967 | Schwartz | 362/116 |
| 3,310,668 | 3/1967 | Schwartz | 362/116 |
| 3,359,411 | 12/1967 | Schwartz | 362/189 X |
| 3,377,475 | 4/1968 | Frigon | 362/116 |
| 3,716,708 | 2/1973 | Kaye | 362/189 |
| 3,870,843 | 3/1975 | Witte | 362/189 X |
| 4,085,315 | 4/1978 | Wolter et al. | 362/116 |
| 4,392,186 | 7/1983 | Cziment | 362/116 |
| 4,458,300 | 7/1984 | Walsh | 362/189 X |
| 4,521,833 | 6/1985 | Wolter | 362/116 |
| 4,524,409 | 6/1985 | Yakubek | 362/189 |
| 4,628,418 | 12/1986 | Chabria | 362/116 |
| 4,819,140 | 4/1989 | Griffin | 362/205 X |
| 4,875,142 | 10/1989 | Spector | 362/205 X |
| 4,885,666 | 12/1989 | Yu | 362/189 |

*Primary Examiner*—Ira S. Lazarus
*Assistant Examiner*—Thomas M. Sember
*Attorney, Agent, or Firm*—John R. Flanagan

[57] ABSTRACT

A miniature pocket flashlight includes a battery receptacle and electrical switch unit, a lamp, and a lens module with an integral lens element which are all encased and covered by an outer sheath of flexible material. The lens module are mounted to an end of the battery receptacle and electrical switch unit and has a central passage formed therein behind the lens element which receives, surrounds and protects the lamp which is also mounted and electrically connected to the one end of the unit. The flexible outer sheath of the pocket flashlight is formed by a pair of flexible flaps integrally connected together at one end where they define an aperture for external exposure of an end of the lens element. The outer sheath is stretched over the components and the peripheral edges of the flexible flaps are attached to one another so as to encase and enclose and thereby retain together the lens module, lamp and battery receptacle and electrical switch unit.

9 Claims, 1 Drawing Sheet

MINIATURE POCKET FLASHLIGHT WITH LENS MODULE AND OUTER FLEXIBLE SHEATH

TECHNICAL FIELD

The present invention generally relates to a miniature pocket flashlight and, more particularly, is concerned with a miniature pocket flashlight having a lamp surrounded and protected by a lens module and an outer sheath of flexible material encasing and covering all components of the flashlight except for an end of a lens element of the lens module exposed externally through an aperture in the outer sheath.

BACKGROUND ART

Miniature pocket flashlights which can be stored in a pocket or attached to a key chain are known in the prior art. An example of a miniature pocket flashlight is the one disclosed in U.S. Pat. No. 4,628,418 to Chabria. The Chabria miniature pocket flashlight has a hollow flexible outer case open at opposite ends, a pair of end caps closing the opposite ends of the outer case, a battery receptacle and electrical switch unit disposed in the case which is activated by squeezing the flexible case, and a lamp electrically connected and mounted to the unit and protruding through a hole in one of the end caps on the case (or alternatively the lamp is mounted to a socket in the end cap itself). At least the one end cap is removable in order to replace the lamp and batteries.

The design of the Chabria flashlight embodies at least three major drawbacks. First, the design permits light generated by the lamp to disperse in all possible radial directions from the lamp thus reducing the amount of light projected by the lamp on any one desired location. Second, the design requires that the lamp extend through a hole or from a socket in the end cap of the case. This design requirement leaves the lamp unprotected, exposing it to frequent impacts with extraneous objects while the flashlight is being handled and carried by the user. Such impacts are likely to soon cause breakage of the lamp filament and result in malfunction and premature shortening of the useful life of the lamp. Third, the design requires that one or both of the end caps of the case be frictionally fitted to the ends of the case so as to be readily removable to replace the lamp and batteries. Over time such frictional fit tend to loosen up and allow the parts of the flashlight to come apart. This increases the risk of losing an end cap which would then require the replacement of the flashlight itself.

In view of the aforementioned drawbacks of the pocket flashlight design of the above-cited Chabria patent, it is readily apparent that a need still remains for a more functional and reliable miniature pocket flashlight design.

DISCLOSURE OF INVENTION

The present invention provides a miniature pocket flashlight designed to satisfy the aforementioned needs. The miniature pocket flashlight of the present invention comprises: (a) means for generating light including a lamp operable to emit light and a lens element disposed adjacent to the lamp and adapted to transmit the light emitted by the lamp; and (b) an outer sheath of flexible material encasing and covering the light generating means, the outer sheath having an aperture defined therein, the lamp being disposed internally of the outer sheath and aligned with and spaced from the aperture, the lens element having an end disposed in the aperture and extending between the aperture and lamp.

The light generating means also includes a battery receptacle and electrical switch unit and a lens module. The lamp is mounted at one end of the unit and electrically connected thereto. The lens module is mounted to the same one end of the unit as the lamp and receives, surrounds and protects the lamp.

More particularly, the lens module includes a pair of side members mounted on the one end of the unit at opposite sides of the lamp. The side members together define a central passage therebetween which receives the lamp therein. The lens module also includes the lens element which is connected to adjacent portions of the side members and bridges over an outer end of the central passage and so is disposed in front of the lamp.

The flexible outer sheath of the pocket flashlight is formed by a pair of flexible flaps integrally connected together at one end where the aperture is defined which externally exposes the end of the lens element. The remaining peripheral edges of the flaps are permanently attached to one another to thereby completely and permanently encase and enclose all of the components of the flashlight and not allow them to come apart over time.

With such enhanced construction, the miniature pocket flashlight of the present invention provides an overall package which is thin, compact and streamlined, and has a soft appearance and feel to the user. It is similar in size and shape to conventional key holders with which users are already familiar. The flashlight provides a highly fashionable item as well as providing the lighting function. The lens element enhances the lighting function by increasing the focus of the light generated by the lamp to better illuminate objects.

Also, due to such enhanced construction of the flashlight, its durability and reliability are greatly enhanced, its useful life is greatly extended, and its cost of manufacture is relatively low such that the flashlight is sufficiently economical as to make the replacement of the lamp and batteries unnecessary.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

BEST MODE FOR CARRYING OUT THE INVENTION

Figures 1, 2, 3, 4, 5, 6, 7:
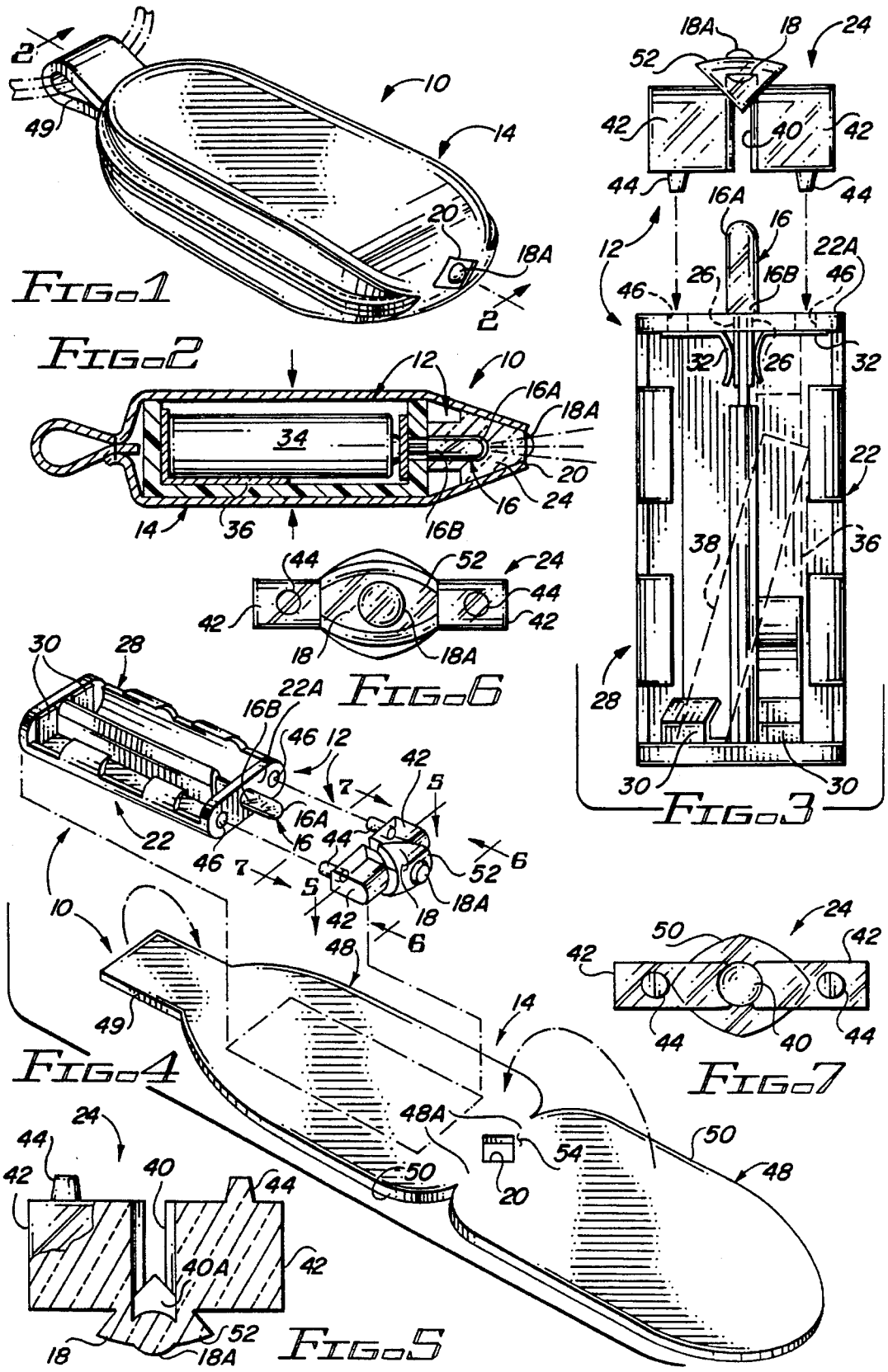
FIG. 1 is a perspective view of the miniature pocket flashlight of the present invention.
FIG. 2 is a longitudinal sectional view of the flashlight taken along line 2—2 of FIG. 1.
FIG. 3 is an enlarged exploded top plan view of a lens module, a lamp, and a battery receptacle and electrical switch unit of the flashlight in FIG. 1.
FIG. 4 is an exploded perspective view of the flashlight of FIG. 1, showing in a blank layout form an outer flexible sheath which is employed to encase and enclose the lens module, lamp, and battery receptacle and electrical switch unit.
FIG. 5 is an enlarged longitudinal sectional view of the lens module as viewed in the direction of arrows 5—5 of FIG. 4.
FIG. 6 is an enlarged front elevational view of the lens module as seen along line 6—6 of FIG. 4.
FIG. 7 is an enlarged rear elevational view of the lens module as seen along line 7—7 of FIG. 4.

Referring to the drawings and particularly to FIGS. 1 to 4, there is illustrated a miniature pocket flashlight, generally designated 10, of the present invention. Basically, the miniature pocket flashlight 10 includes means 12 for generating light and an outer sheath 14 of a suitable flexible material substantially encasing and covering the light generating means 12. The light generating means 12 includes a lamp 16 operable to emit light and a lens element 18 disposed adjacent to the lamp 16 and adapted to transmit the light emitted by the lamp 16. The flexible outer sheath 14 has an aperture 20 defined in an end thereof. The lamp 16 being disposed internally of the outer sheath 14 is aligned with and but spaced from the aperture 20, while the lens element 18 has an end 18A disposed in the aperture 20 and extending between the aperture 20 and an outer end 16A of the lamp 16.

Referring to FIGS. 2 to 4, the light generating means 12 of the flashlight 10 also includes a battery receptacle and electrical switch unit 22 and a lens module 24. The lamp 16 has a pair of terminal posts 26 extending from an iner end 16B thereof by which the lamp 16 is mounted at one or a front end 22A of the unit 22 and electrically connected thereto. The lamp thus mounted on the front end 22A of the battery receptacle and electrical switch unit 22 extends externally from the unit 22 but internally in the outer casing 14.

The battery receptacle and electrical switch unit 22 includes a battery case 28 made of an electrically non-conductive or insulative material and containing a pair of rear electrical spring contacts 30, a pair of front electrical terminals 32, and a pair of d.c. batteries 34 (not shown in FIGS. 3 and 4) extending therebetween and in electrical contact therewith. Also, the unit 22 includes a pair of electrical switch levers 36, 38 connected with the rear spring contacts 30. The front terminals 32 electrically contact respectively the pair of terminal posts 26 of the lamp 16. The abovedescribed components of the unit 22 and the lamp 16 are thusly arranged to define an electrical circuit which normally is in an opened or "off" condition in view that the pair of switch levers 36, 38 are normally spaced in non-contacting relationship from one another. By squeezing opposite sides of the outer casing 14 toward one another, the switch levers 36, 38 are brought into electrical contact with one another electrically switching the circuit from the opened or "off" to a closed or "on" condition. The lamp 16 electrically mounted to the unit 22 then generates light when the unit 22 is switched on.

Referring to FIGS. 2 to 7, the lens module 24 is mounted to the same one front end 22A of the unit 22 as the lamp 16 and defines a central passage 40 which receives, surrounds and protects the lamp 16. More particularly, the lens module 24 includes a pair of side members 42 of generally rectangular shape and being mounted on the one front end 22A of the unit 22 at opposite sides of the lamp 16. Specifically, the side members 42 are connected to the front end 22A of the unit 22 by rearwardly protruding posts 44 on the side members 42 fitting within holes 46 in the front end 22A of the unit 22 and are permanently and rigidly secured thereon by gluing the posts 44 and adjacent surfaces of the side members 42 thereto. The side members 42 together define the central passage 40 therebetween which receives the lamp 16 therein.

The lens module 24 also includes the lens element 18 which is disposed between and connected to adjacent front portions of the side members 42 and bridges over an outer end 40A of the central passage 40 and so is disposed in front of the lamp 16 where it is aligned with the lamp 16 so as to transmit the light generated by the lamp 16. Further, the lens element 18 is preferably of optical quality and is disposed in optical alignment with the lamp 16 so as to increase the focus of the light emitted by the lamp 16 and thereby provide enhance illumination of a specific area in front of the flashlight 10.

The flexible outer sheath 14 of the flashlight 10 is formed by a pair of flexible flaps 48 facing toward one another in an opposing relationship and integrally connected together at adjacent end portions 48A where the aperture 20 is defined and externally exposes only the end 18A of the lens element 18. The flaps 48 of the outer sheath 14 are stretched over the internally located components and the remaining peripheral edges 50 of the flaps 48, extending from the integrally connected end portions 48A thereof, are permanently attached to one another in any suitable manner, such as by stitching or bonding, to thereby completely and permanently encase and enclose all of the internal components of the flashlight 10, namely, the battery receptacle and electrical switch unit 22, lamp 16 and lens module 24, except for the end 18A of the lens element 18 thereof which is exposed through the aperture 20 in the outer sheath 14. The outer sheath 14 thereby retains together such internal components so that they will not come apart over time. The outer sheath 14 also includes a tab 49 which can be looped and attached, such as sewn, between the peripheral edges 50 of the flaps 48, as seen in FIG. 2, in order to hang the flashlight 10 on a key chain C, as shown in dashed outline form in FIG. 1. The outer sheath 14 can be made of any suitable material, such as leather, neoprene, or vinyl to name just a few.

Also, as seen in FIGS. 1 to 6, the lens element 18 of the lens module 24 defines an annular peripheral shoulder 52 surrounding the end 18A thereof. An annular edge portion 54 of the flexible outer sheath 14 which defines and surrounds the aperture 20 therein seats upon the peripheral shoulder 52 of the lens element 18. The end 18A of the lens element 18 also extends outwardly from the aperture 20 and slightly externally of the outer casing 14. The end 18A of the lens element 18 has a dome-shaped configuration and protrudes outwardly from the annular shoulder 52.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

We claim:

1. A miniature pocket flashlight, comprising:

(a) means for generating light including a battery receptacle and electrical switch unit, a lamp at one end mounted to one end of said battery receptacle and electrical switch unit and electrically connected thereto and being operable to emit light and a lens module mounted to said one end of said battery receptacle and electrical switch unit and surrounding said lamp, said lens module including a lens element disposed adjacent and in overlying relation to said lamp and adapted to transmit the light emitted by said lamp; and (b) an outer sheath of flexible material encasing and covering said battery receptacle and electrical switch unit, said lamp, and said lens module of said light generating means except for an outer end of said lens element of said lens module, said outer sheath having an aperture defined in one end thereof such that only said lens element outer end of said lens module of said light generating means is exposed through said aperture in said one end of said outer sheath, said lamp being disposed internally of said outer sheath and aligned with and spaced from said aperture, said lens element of said lens module extending between said aperture and lamp and having a peripheral shoulder surrounding said outer end thereof and supporting an annular edge portion of said outer sheath which defines said aperture in said one end thereof;

(c) said flexible outer sheath being formed solely by a pair of flexible flaps facing toward one another in an opposing relationship and being integrally connected together solely at said one end of said outer sheath where said aperture is defined, said flexible flaps having peripheral edges extending about said flaps from said one end of said outer sheath and being attached to one another so as to encase and enclose said battery receptacle and electrical switch unit, said lamp and lens element of said lens module, except for said outer end of said lens element of said lens module being exposed through said aperture in said one end of said outer sheath, and thereby retain together said battery receptacle and electrical switch unit, said lamp and said lens module.

2. The flashlight of claim 1 wherein said lens element is disposed in optical alignment with said lamp and adapted to increase the focus of the light emitted by said lamp.

3. The flashlight of claim 1 wherein said end of said lens element also extends outwardly from said aperture and externally of said outer sheath.

4. The flashlight of claim 1 wherein said lens module includes a pair of side members mounted on said one end of said unit at opposite sides of said lamp, said side members of said lens module being encased and covered by said outer sheath and defining a central passage therebetween which receives said lamp therein.

5. The flashlight of claim 4 wherein said lens element of said lens module is disposed between and connected to adjacent portions of said side members and bridges over an outer end of said central passage and is disposed forwardly of said lamp between said lamp and said aperture of said flexible outer sheath.

6. A miniature pocket flashlight, comprising:

(a) a battery receptacle and electrical switch unit having a pair of opposite ends and being switchable electrically on and off;

(b) a lamp mounted on one of said opposite ends of the battery receptacle and electrical switch unit and extending externally of the unit, said lamp electrically contacting the unit to generate light when said unit is switched on;

(c) a lens module including a pair of side members mounted on said one end of said battery receptacle and electrical switch unit at opposite sides of said lamp, said side members defining a central passage therebetween receiving said lamp therein, said lens module also including a lens element connected to adjacent portions of said side members and bridging an outer end of said central passage and being aligned with said lamp to transmit the light generated by said lamp; and (d) an outer sheath of flexible material formed solely by a pair of flexible flaps facing toward one another in an opposing relationship and being integrally connected together solely at one end of said outer sheath at which an aperture is defined therethrough for external exposure only of an outer end of said lens element of said lens module, said pair of flaps being permanently attached together at peripheral edges thereof extending about said flaps from said one end of said outer sheath so as to encase and enclose said battery receptacle and electrical switch unit, said lamp and said lens module, except for said outer end of said lens element of said lens module exposed through said aperture in said one end of said outer sheath, and thereby retain together said battery receptacle and electrical switch unit, said lamp and said lens module, said lens element extending between said aperture and lamp and having a peripheral shoulder surrounding said outer end thereof and supporting an annular edge portion of said outer sheath which defines said aperture in said one end thereof.

7. The flashlight of claim 6 whheren said lens element is disposed in optical alignment with said lamp and adapted to increase the focus of the light emitted by said lamp.

8. The flashlight of claim 6 wherein said end of said lens element also extends outwardly from said aperture and externally of said outer sheath.

9. The flashlight of claim 6 wherein said end of said lens element has a dome-shaped configuration and protrudes outwardly from said peripheral shoulder.

* * * * *